US006059890A

United States Patent [19]

Sedore

[11] Patent Number: 6,059,890

[45] Date of Patent: May 9, 2000

[54] METHOD BY VIBRATION FOR REMOVING CONTAMINANTS FROM THE INTERIOR OF PIPE

[76] Inventor: Ronald Stephen Sedore, 143 Allen St., Red Deer, Alberta, Canada, T4R 1E6

[21] Appl. No.: 09/014,362

[22] Filed: Jan. 27, 1998

[51] Int. Cl.[7] ..... B08B 7/02; B08B 9/02

[52] U.S. Cl. ..... 134/8; 134/1; 134/22.11; 134/23

[58] Field of Search ..... 134/1, 8, 22.11, 134/23

[56] References Cited

FOREIGN PATENT DOCUMENTS 1 227 952 10/1987 Canada ..... 74/19
2179021 10/1995 Canada .

*Primary Examiner*—Zeinab El-Arini
*Attorney, Agent, or Firm*—Davis and Bujold

[57] ABSTRACT

A method for removing contaminants from the interior of pipe by vibration. This method includes the single step of securing a vibrator to a pipe with contaminated interior and vibrating the pipe until the contaminants are dislodged. This has particular application to sand bailers used in oil well servicing.

4 Claims, 2 Drawing Sheets

METHOD BY VIBRATION FOR REMOVING CONTAMINANTS FROM THE INTERIOR OF PIPE

FIELD OF THE INVENTION

The present invention relates to a method and an apparatus for removing contaminants from the interior walls of pipe and, in particular, sand bailers used in oil well servicing.

BACKGROUND OF THE INVENTION

One of the steps involved in servicing a producing oil well is to use a sand bailer to remove silt, sand and other contaminants which accumulates within the wellbore. A sand bailer has a rigid tubular body with a one way valve at one end. The tubular body is dropped or driven into accumulated sand in the wellbore. Sand pushes the one way valve open and passes into the tubular body. When the sand bailer is raised, the one way valve closes trapping the sand within the sand bailer. Suction is used to draw sand out the sand bailer, and the process of dropping or driving the sand bailer into accumulated sand is repeated. Frequently, the sand bailer becomes totally clogged with contaminants. In order to remove the contaminants the servicing crew generally suspends the contaminated pipe by a cable and then bags the tubular body of the sand bailer with hammers to dislodge the contaminants. This method of dislodging of contaminants, which has been in common usage for many years, is time consuming and labour intensive. It also shortens the useful life of the sand bailer.

SUMMARY OF THE INVENTION

What is required is a method and an apparatus for removing contaminants from the interior of sand bailers or other pipe that is less time consuming and labour intensive.

According to one aspect of the present invention there is provided a method for removing contaminants from the interior of pipe. This method includes the single step of securing vibrating means to a pipe with contaminated interior and vibrating the pipe until the contaminants are dislodged.

With the method, as described above, the contaminants are rapidly dislodged mechanically by vibrating the pipe. The mechanical vibration of the pipe does not damage the pipe in any way.

According to another aspect of the present invention there is provided an apparatus for removing contaminants from the interior of pipe. This apparatus includes a body, means for securing the body tightly against a pipe, and means for vibrating the body.

The preferred means for securing the body against a pipe includes at least one chain or cable. The chain or cable has a fixed end fixed to the body and a free end. The body has means for clamping the chain/cable to secure the chain/cable in a loop when the free end is wrapped around the pipe.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
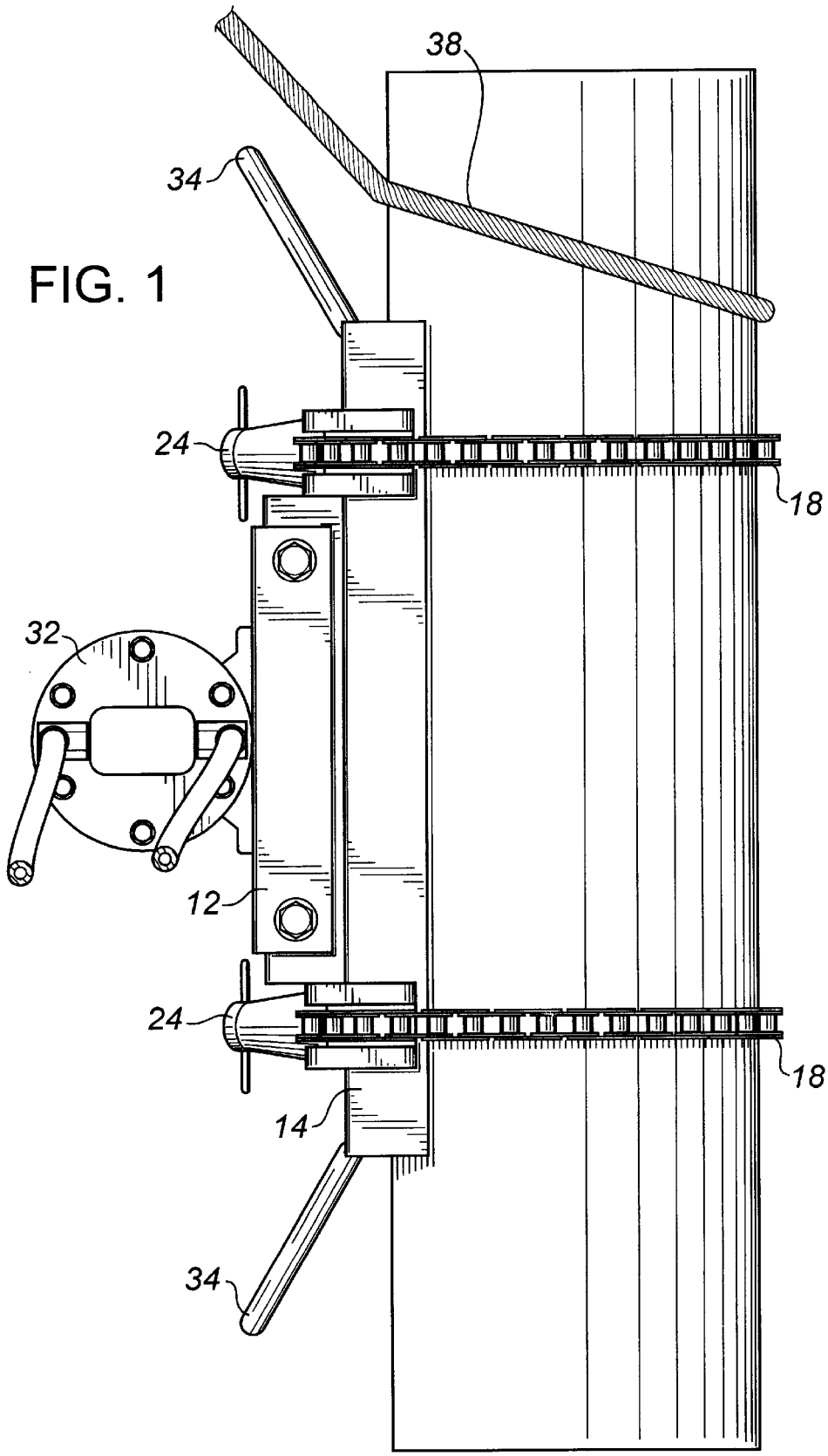
FIG. 1 is a side elevation view of an apparatus for removing contaminants from the interior of pipe constructed in accordance with the teachings of the present invention, secured to a pipe.

The preferred embodiment, an apparatus for removing contaminants from the interior of pipe generally identified by reference numeral 10, will now be described with reference to FIGS. 1 and 2.

Figure 2:
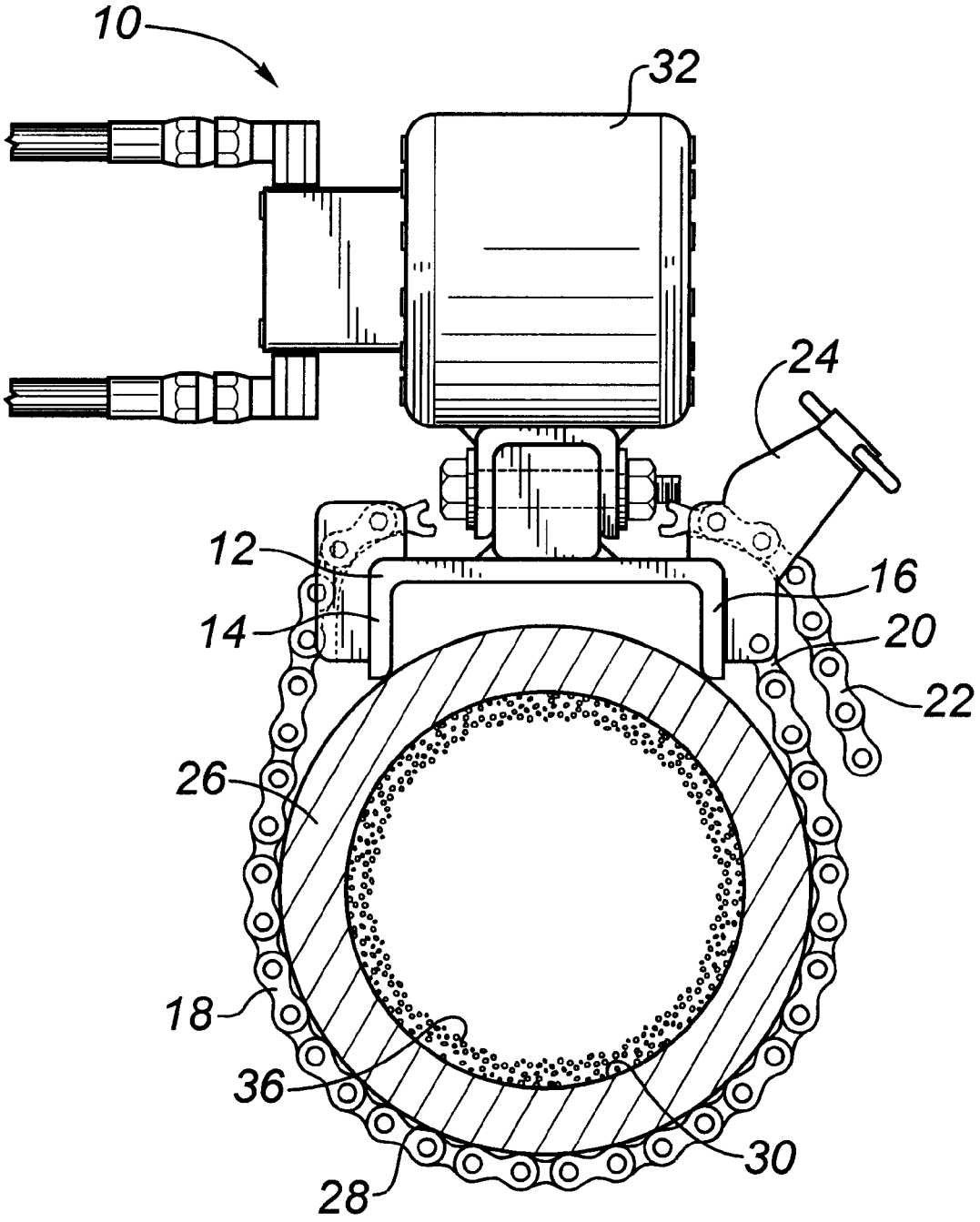
FIG. 2 is a top plan view, in section, of the apparatus illustrated in FIG. 1.

Referring to FIG. 2, apparatus 10 includes a body 12 having a first side 14 and a second side 16. A pair of securing members which are chains 18 are provided, each of which has a fixed end 20 and a free end 22. Although chains are illustrated, it will be appreciated that cables would be serve the intended function. Fixed ends 20 of chains 18 are secured in spaced relation to second side 14 of body 12. A pair of chain engaging clamps 24 are mounted on second side 16 of body 12 in spaced relation. A pipe 26 is illustrated which has an exterior surface 28 and an interior wall 30. Chains 18 are wrapped tightly in a loop around exterior surface 28 of pipe 26. Chain engaging clamps 24 then clamp chains 18 adjacent to free ends 22, thereby securing to body 12 to exterior surface 28 of pipe 26. A vibration imparting drive motor 32 is mounted on body 12. Typically, drive motor 32 will have an eccentric rotor (not shown) so that operation of drive motor 32 causes vibration. There are a variety of technologies suitable for drive motor 32, it may be electric, hydraulic, pneumatic or the like. For convenience, it is preferred that body 12 have spaced apart lifting handles 34, so that body 12 may be lifted into position.

The use and operation of apparatus 10 will now be described with reference to FIGS. 1 and 2 and the preferred method. Pipe 26 is illustrated having sand and clay contaminants 36 clinging to interior wall 30. Firstly, secure body 12 of apparatus 10 to exterior surface 28 of pipe 26. This is accomplished by wrapping chains 18 tightly in a loop around exterior surface 28 of pipe 26. Chain engaging clamps 24 are used to clamp chains 18 adjacent to free ends 22, thereby securing to body 12 to exterior surface 28 of pipe 26. Secondly, suspending pipe 26 on a line 38. By suspending pipe 26 on line 38, pipe 26 is kept clear of any surface that might dampen vibration. Thirdly, activate drive motor 32 to vibrate pipe 26 until contaminants 36 become dislodged.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method for removing contaminants from an interior wall of a pipe, the method comprising the steps of:

providing:

a body;

at least one securing chain having one end fixed to the body and a free end;

at least one clamp secured to the body, the clamp being adapted to receive and secure the free end of the securing chain; and an eccentric drive motor secured to the body;

providing a pipe with sand and silt contaminants clinging to an interior wall of the pipe;

positioning the body on an exterior surface of the pipe;

securing the body to the pipe by wrapping the free end of the at least one securing chain around the pipe and securing said free end in the at least one clamp;

suspending the pipe by means of a line; and activating the eccentric drive motor to impart vibration to the pipe and facilitate dislodging the sand and silt contaminants from the interior wall of the pipe by such vibrations.

2. A method for removing contaminants form an interior wall of a pipe, the method comprising the steps of:

providing:

a body;

at least one securing chain having one end pivotally affixed to an exterior surface of the body and the at least one securing chain having a remote free end;

at least one clamp secured to the exterior surface of the body, the at least one clamp facilitating receiving and securing of the remote free end of the securing chain about a pipe; and an eccentric drive motor secured to the body to impart vibration to the body upon operation of the eccentric drive motor;

providing a pipe with sand and silt contaminants clinging to an interior wall of the pipe;

placing the body against an exterior surface of the pipe;

securing the body to the pipe by wrapping the free end of the at least one securing chain around an exterior periphery of the pipe and securing said free end of the at least one clamp to support the body to the pipe;

lifting and suspending the pipe and the secured body via a line; and operating the eccentric drive motor to impart vibrations to the pipe and facilitate dislodging the sand and silt contaminants from the interior wall of the pipe via such vibrations.

3. The method according to claim 2, further comprising the steps of providing the body with a pair of spaced apart securing chains each having one end pivotally secured to an exterior surface of the body; and providing a pair of clamps each secured to the exterior surface of the body, the pair of clamps facilitating receiving and securing of the remote free end of one of the securing chains about the pipe.

4. A method for removing contaminants from an interior wall of a pipe, the method comprising the steps of:

providing:

a body;

at least one securing member having one end fixed to the body and a free end;

at least one clamp secured to the body, the clamp being adapted to receive and secure the free end of the securing member; and an eccentric drive motor secured to the body;

providing a pipe with sand and silt contaminants clinging to an interior wall of the pipe;

positioning the body on an exterior surface of the pipe;

securing the body to the pipe by positioning the at least one securing member around the pipe and securing said free end in the at least one clamp;

suspending the pipe via a line; and actuating the eccentric drive motor to impart vibration to the pipe and facilitate dislodging the sand and silt contaminants from the interior wall of the pipe by such vibrations.

* * * * *